US005353480A

United States Patent [19]

Kayaki et al.

[11] Patent Number: 5,353,480

[45] Date of Patent: Oct. 11, 1994

[54] DECORATIVE SLIDER FOR SLIDE FASTENERS

[75] Inventors: Keiichi Keyaki, Kurobe; Hitomi Kawamura, Tateyama, both of Japan

[73] Assignee: Yoshida Kogyo K.K., Tokyo, Japan

[21] Appl. No.: 114,923

[22] Filed: Sep. 2, 1993

[30] Foreign Application Priority Data

Sep. 16, 1992 [JP] Japan ..... 4-074601[U]

[51] Int. Cl.[5] ..... A44B 19/00

[52] U.S. Cl. ..... 24/429; 24/419

[58] Field of Search ..... 24/429, 419, 420, 427, 24/428, 431, 437, 430, 381

[56] References Cited

U.S. PATENT DOCUMENTS

| | | | |
|---|---|---|---|
| 2,671,258 | 3/1954 | Lackritz | 24/419 |
| 2,681,492 | 6/1954 | Lackritz | 24/429 |
| 3,343,235 | 9/1967 | Morin | 24/429 |
| 3,376,617 | 4/1968 | Snyder | 24/419 |
| 3,718,949 | 3/1973 | Harlam et al. | 24/429 |
| 5,067,209 | 11/1991 | Terada et al. | 24/429 |

FOREIGN PATENT DOCUMENTS

| | | | |
|---|---|---|---|
| 0423570A1 | 4/1991 | European Pat. Off. . | |
| 0502840A1 | 9/1992 | European Pat. Off. . | |
| 1282614 | 12/1961 | France . | |
| 0524035 | 7/1940 | United Kingdom | 24/429 |

*Primary Examiner*—Victor N. Sakran

*Attorney, Agent, or Firm*—Hill, Steadman & Simpson

[57] ABSTRACT

A decorative slider for slide fasteners has a slider body having a through mounting hole extending therethrough. A decorative plate has a through hole formed therethrough and placed on the slider body with the through hole aligned with the mounting hole. A retaining pin extends loosely through the through hole and is fitted in the mounting hole so as to attach the decorative plate to the slider body for diversifying the appearance of sliders without changing the whole appearance of the slider.

3 Claims, 4 Drawing Sheets

DECORATIVE SLIDER FOR SLIDE FASTENERS

BACKGROUND OF THE INVENTION

1. Field of the Invention

The present invention relates generally to a slider for slide fasteners, and more particularly to a decorative slider designed to appeal to consumers aesthetically.

2. Description of the Prior Art

These days, it is often said that consumer's tastes and demands concerning products, especially, in their designs are very diversified. Furthermore, consumers desire to have what others do not. This trend of consumers forces manufactures to produce, stock in their warehouse and supply to the market sliders of various appearances or designs. Heretofore, in order to produce slider bodies of a variety of appearances, manufacturers must start from scratch by producing molds for slider bodies of a variety of appearances. This, however, disadvantageously costs alot and takes a long time.

SUMMARY OF THE INVENTION

With the foregoing difficulties in view, it is, therefore, an object of the present invention to provide a decorative slider for slide fasteners which has overcome the foregoing drawbacks.

It is another object of the present invention to provide a decorative slider for slide fasteners whose appearance can be diversified by simply mounting on a slider body decorative plates of various shapes, designs, colors or materials as consumers required, without the necessity of changing the appearance of the slider body.

According to the present invention, there is provided a decorative slider for slide fasteners comprising: a slider body including a pair of spaced upper and lower wings and a guide post joining the upper and lower wings at their front end, the slider body having a mounting through hole extending therethrough at the guide post; a decorative plate having a through hole formed therethrough and placed on the upper wing with the through hole aligned with the mounting hole; an annular joint member having a guide hole formed therethrough and placed on the decorative plate with the guide hole aligned with the through hole; a pull tab pivotally connected to the annular joint member; and a retainer pin having an enlarged head and a shank extending from a lower side of the head, the shank extending loosely through the guide hole, through the through hole and fitted in the mounting hole to join the retainer pin with the slider body.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PRESENTLY PREFERRED EMBODIMENTS

Figure 1:
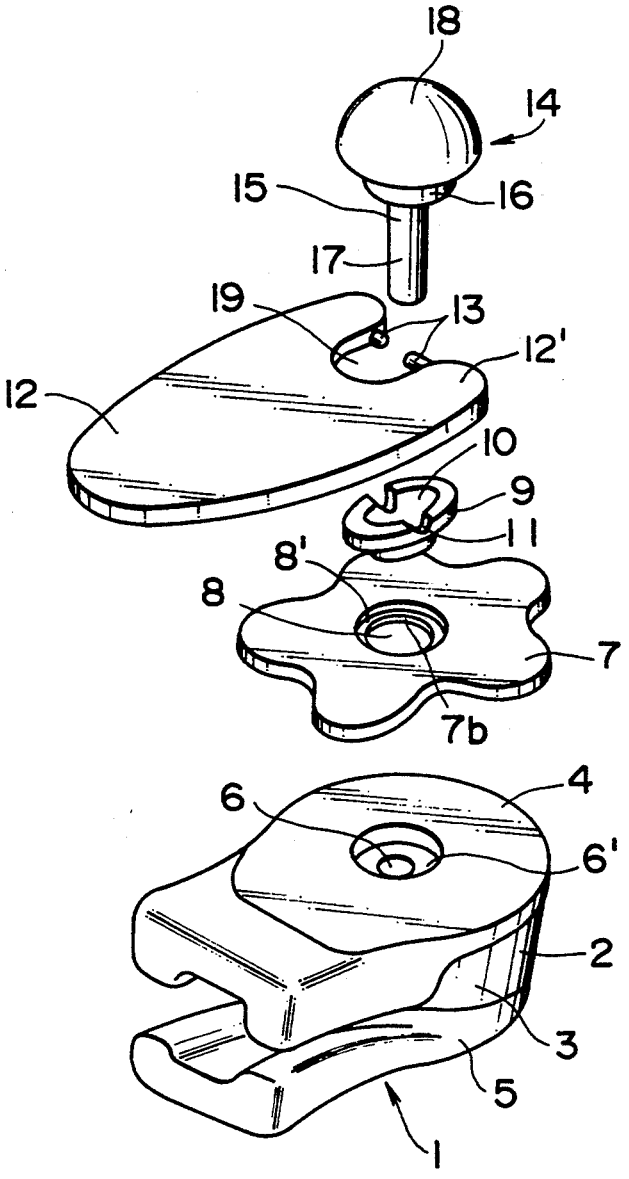
FIG. 1 is an exploded perspective view of a decorative slider for slide fasteners according to the present invention.

Referring first to FIG. 1, a decorative slider according to the present invention broadly comprises a slider body 1, decorative plate 7, an annular joint member 9, a pull tab 12 and a retainer pin 14.

As better shown in FIG. 1, the slider body 1 comprises a pair of parallel spaced upper and lower wings 4, 5 and a guide post 3 joining the wings 4, 5 at their front end. The slider body 1 further has a vertical mounting hole 6 extending therethrough at the guide post 3. The mounting hole 6 has an upper circular counterbore 6' formed in one end edge thereof in the upper surface of the upper wing 4 and a lower counter bore (not shown) in the other end edge thereof in the lower surface of the lower wing 5.

Figure 2:
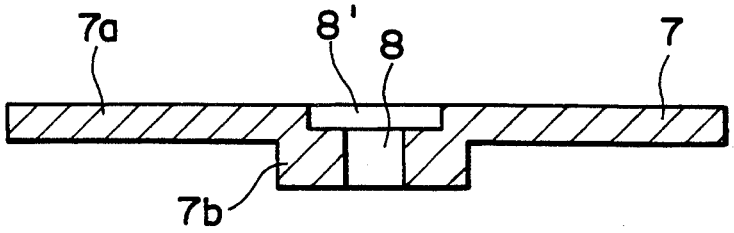
FIG. 2 is a cross-sectional view of a decorative plate of the slider of FIG. 1.

The decorative plate 7 may be made of any desired material. As shown in FIGS. 1 and 2, the decorative plate 7 comprises a plate body **7*a* and a circular hub portion 7*b* centrally formed on the lower side of the plate body 7*a* and adapted for fitting engagement with the upper counterbore 6 of the slider body 1. Although the plate body 7*a* illustrated in FIG. 1 is of star shape, the decorative plate 7 may be of any shape and any color that can appeal to viewers aesthetically. As better shown in FIG. 2, the decorative plate 7 has a through hole 8 formed substantially centrally therethrough. The through hole 8 has a countersink 8' opening to the upper surface of the plate body 7*a* and formed concentrically with the through hole 8**.

Figure 3:
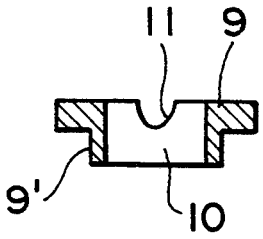
FIG. 3 is a cross-sectional view of an annular joint member of the slider of FIG. 1.

As better shown in FIG. 3, the annular joint member 9 has a central guide hole 10 formed centrally therethrough. The annular joint member 9 also has a peripheral rim 9' formed on its lower side around the central guide hole 10 for fitting engagement with the countersink 8' of the decorative plate 7. The annular joint member 9 further has a pair of cutaway concave notches 11 formed in its upper side in diametrically opposite relation to each other.

As shown in FIG. 1, the pull tab 12 is a plate flat and elongate enough to facilitate grasping it with fingers. The pull tab 12 is bifurcated at its front end to provide a pair of opposed front arms 12', 12' defining therebetween a cutaway recess 19 which is slightly larger than the diameter of the annular joint member 9. The opposed front arms 12', 12' have a pair of aligned spindles 13, 13 provided on the respective confronting sides thereof.

The retainer pin 15 is used for retaining the decorative plate 7 and the annular joint member 9 to the slider body 1. The retainer pin 14 generally comprises an enlarged circular head 18 and a cylindrical shank 15 extending centrally from the lower side of the circular head 18. The cylindrical shank 15 is stepped and includes a large-diameter upper portion 16 formed immediately beneath the circular head 18 and a small diameter lower portion 17 formed concentrically on the lower side of the large-diameter portion 16. The large-diameter upper portion 16 is adapted for fitting engagement with the central guide hole 10 of the annular joint member 9, while the small-diameter portion 17 is adapted for loose fitting engagement with the through hole 8 of the decorative plate 7 and the mounting hole of the slider body 1. The circular head 18 is substantially equal in diameter to the annular joint member 9 and less than the recess 19 of the pull tab 12 so as not to prevent the circular head 18 from interfering with the pivotal movement of the pull tab 12 after the assemblage of the slider.

The decorative plate 7 may be mounted on the slider body 1 either fixedly or non-rotatably, or rotatably independently or dependently of the pull tab 12. The decorative plate 7 can be fixedly mounted on the slider body 1 simply by fitting a protuberant lug (not shown) provided on the lower side of decorative plate 7 into a recess (not shown) formed in the upper surface of the upper wing 4, vice versa. Likewise, the decorative plate 7 may be mounted fixedly relative to the annular joint member 9.

For assembling, as shown in FIG. 1, the decorative plate 7 is placed on the upper wing 4 of the slider body 1 with the central hub **7*b* received in the counterbore 6' of the slider body 1. Then, the annular joint member 9 is placed on the decorative plate 7 with the lower rim 9' received in the countersink 8'. Subsequently, the aligned spindles 13 of the pull tab 12 are received in the concave cutaway notches 11 in the annular joint member 9 so as to pivotally connect the pull tab 12 to the annular joint member 9. Thereafter, the cylindrical shank 15 of the retainer pin 14 is inserted through the central guide hole 10 of the annular joint member 9 and through the through hole 8 of the decorative plate 7 into the mounting hole 6 of the slider body 1 until the large-diameter upper pin portion 16 of the shank 15 is seated into the central guide hole 10 of the annular joint member 9. In this instance, the lower end of the shank 15 slightly projects from the lower surface of the lower wing 5. Then, the projecting lower end of the shank 15 is flattened against the lower counterbore (not shown) so that the retainer pin 14 is firmly clinched to the slider body 1. In this event, the circular head 18 of the retainer pin 14 closes the notches 11, 11 and confine the aligned spindles 13 within the notches 11, 11 so that the pull tab 12 is pivotally mounted on the slider body 1. As a result, the decorative plate 7 and the pull tab 12 is rotatably mounted on the slider body 1**.

As set forth hereinabove, the decorative plate 7 of various shapes or colors may be mounted on a slider body 1.

Figure 4:
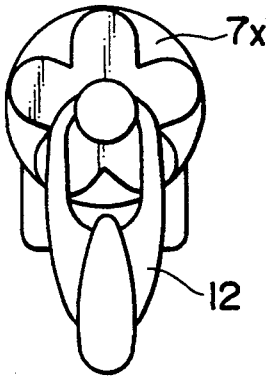
FIG. 4 is a plan view of a decorative slider according to another embodiment of the present invention.

FIG. 4 shows a decorative slider according to a second embodiment. This slider is substantially identical with the slider according to the first embodiment except that it has a flower-shaped decorative plate **7*x*** instead of the star-shaped decorative plate.

Figure 5:
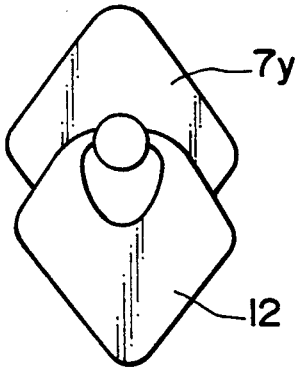
FIG. 5 is a view similar to FIG. 4 but showing still another embodiment of the present invention.
Figure 6:
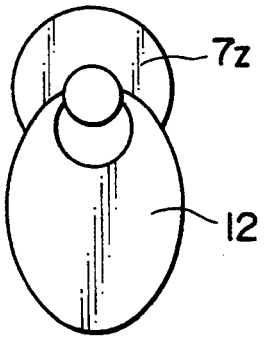
FIG. 6 is a view also similar to FIG. 5 but showing yet another embodiment of the present invention.

FIGS. 5 and 6 show decorative sliders according to still other embodiments. These sliders are substantially identical with the slider according to the first embodiment with the exception that the slider has a diamond-shaped decorative plate **7*y* (FIG. 5) or a circular decorative plate 7*z* (FIG. 6**).

Figure 7:
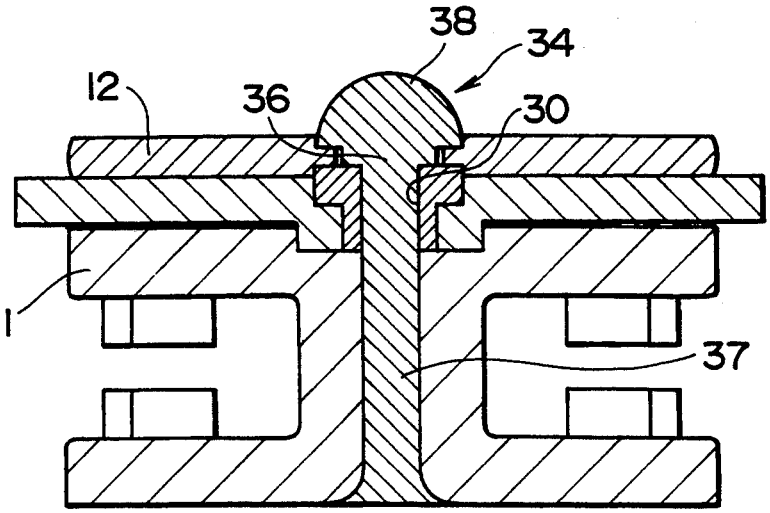
FIG. 7 is a cross-sectional view of a decorative slider according to still another modification.
Figure 8:
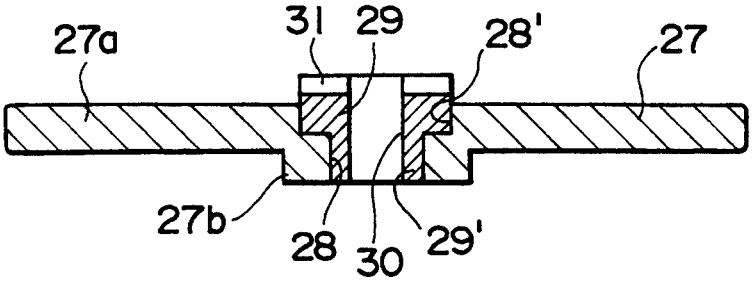
FIG. 8 is a cross-sectional view of an annular joint member and a decorative plate, joined with each other, of the decorative slider of FIG. 7.

FIGS. 7 and 8 show a decorative slider according to still another embodiment, and its decorative plate 27 and annular joint member 29 joined with each other, respectively. This slider is substantially identical with the slider according to the first embodiment except that the annular joint member 29 is snugly fitted in the countersink 28' of the decorative plate 27 with the lower rim 29' of the annular joint member 29 snugly fitted in the through hole 28, as shown in FIG. 8. And, the small-diameter lower pin portion 37 of the retainer pin 34 is snugly fitted through the central guide hole 30 of the annular joint member 30, as shown in FIG. 7. With such snug fitting, the decorative plate 27 is rotated just as the pull tab 12 is rotated on the slider body 1. This will impart consumers unique and fancy feeling.

With the construction set forth hereinabove, the decorative slider according to the present invention enjoys the following advantages.

The appearance of the slider is diversified simply by mounting on a slider body decorative plates of various shapes, designs, colors or materials as a consumer requires, without the necessity of changing the appearance of the slider body. Consequently, this decorative slider can meet diversified demands of the consumers in terms of product designs without compromising the manufacturing cost.

Obviously, various modifications and variations of the present invention are possible in light of the above teaching. It is, therefore, to be understood that within the scope of the appended claims the invention may be practiced otherwise than as specifically described.

What is claimed is:

1. A decorative slider for slide fasteners comprising:

a slider body having an upper wing and a lower wing spaced by a guide post joining the upper wing and the lower wing at one end, the slider body having a mounting hole extending therethrough formed in a recess at the guide post;

a decorative plate having a through hole formed therethrough and placed on the upper wing with the through hole aligned with the mounting hole, the decorative plate mounted without requiring separate attachment;

an annular joint member having a guide hole formed therethrough and placed on the decorative plate with the guide hole aligned with the through hole;

a pull tab pivotally connected to the annular joint member; and a retainer pin having an enlarged head and shank extending from a lower side of the head, the shank extending loosely through the guide hole, through the through hole and fitted in the mounting hole to join the retainer pin with the slider body.

2. The decorative slide fastener according to claim 1 wherein the decorative plate is fixed to the slider body.

3. The decorative slide fastener according to claim 1 wherein the decorative plate is rotatable relative to the slider body.

* * * * *